US009476007B2

(12) United States Patent
Ajayi et al.

(10) Patent No.: US 9,476,007 B2
(45) Date of Patent: Oct. 25, 2016

(54) TRIBOLOGICAL SYNTHESIS METHOD FOR PRODUCING LOW-FRICTION SURFACE FILM COATING

(71) Applicant: UCHICAGO ARGONNE LLC, Chicago, IL (US)

(72) Inventors: Oyelayo O. Ajayi, Oswego, IL (US); Maria De La Lorenzo-Martin, Darian, IL (US); George R. Fenske, Downers Grove, IL (US)

(73) Assignee: UChicago Argonne, LLC, Chicago, IL (US)

( * ) Notice: Subject to any disclaimer, the term of this patent is extended or adjusted under 35 U.S.C. 154(b) by 262 days.

(21) Appl. No.: 14/038,121

(22) Filed: Sep. 26, 2013

(65) Prior Publication Data

US 2015/0087566 A1 Mar. 26, 2015

(51) Int. Cl.
*C10M 177/00* (2006.01)
*C10M 113/08* (2006.01)

(52) U.S. Cl.
CPC .... *C10M 177/00* (2013.01); *C10M 2201/0403* (2013.01); *C10M 2203/003* (2013.01); *C10M 2205/0285* (2013.01); *C10M 2227/066* (2013.01); *C10N 2210/01* (2013.01); *C10N 2210/06* (2013.01); *C10N 2230/06* (2013.01); *C10N 2250/141* (2013.01); *C10N 2280/00* (2013.01)

(58) Field of Classification Search
CPC ..... C10M 177/00; C10M 2201/0403; C10M 2203/003; C10M 2205/0285; C10M 2227/066; C10N 2210/01; C10N 2210/06; C10N 2230/06; C10N 2250/141; C10N 2280/00
USPC ..... 508/100, 103
See application file for complete search history.

(56) References Cited

U.S. PATENT DOCUMENTS

2010/0272931 A1 10/2010 Stavlid

FOREIGN PATENT DOCUMENTS

SE WO 2012008890 A1 * 1/2012 ..... C10M 125/22
WO WO 2012/008890 1/2012

OTHER PUBLICATIONS

Drees, et al., Friction of Thin Coatings on Three Length Scales under Reciprocating Sliding, Surface & Coatings Technology, 2004, pp. 511-518, vol. 188-189, Elsevier.
Haubert, An Overview on the Tribological Behavior of Diamond-Like Carbon in Technical and Medical Applications, Tribology International, 2004, pp. 991-1003, vol. 37, Elsevier.
Kano, Super Low Friction of DLC Applied to Engine Cam Follower Lubricated with Ester-Containing Oil, Tribology International, 2006, pp. 1682-1685, vol. 39, Elsevier.
Muratore, et al., Chameleon Coatings: Adaptive Surfaces to Reduce Friction and Wear in Extreme Environments, Annu. Rev. Mater. Res., 2009, pp. 297-324, vol. 39.
(Continued)

*Primary Examiner* — James Goloboy
(74) *Attorney, Agent, or Firm* — Foley & Lardner LLP

(57) ABSTRACT

An article of method of manufacture of a low friction tribological film on a substrate. The article includes a substrate of a steel or ceramic which has been tribologically processed with a lubricant containing selected additives and the additives, temperature, load and time of processing can be selectively controlled to bias formation of a film on the substrate where the film is an amorphous structure exhibiting highly advantageous low friction properties.

16 Claims, 14 Drawing Sheets

(56) References Cited

OTHER PUBLICATIONS

Rejowski, et al., Application of DLC Coating in Cylinder Liners for Friction Reduction, SAE International, Apr. 16, 2012, 11 pages.
Wedeven, et al., Performance Map Characterization of Lubricating Oils—Characterization of Gear Lubricants formulated from Different Base Oils, 1993 International Off-Highway & Powerplant Congress & Exposition, Milwaukee, Wisconsin, Sep. 13-15, 1993, pp. 1-12, SAE The Engineering Society for Advancing Mobility Land Sea Air and Space International, SAE Technical Paper Series.
Zhmud, Boris, Developing energy-efficient lubricants and coatings for automotive applications, Tribology & Lubrication Technology, Sep. 2011, pp. 42-49.
Zhmud, et al., ANS Triboconditioning: In-Manufacture Running-in Process for Improving Tribological Properties of Mechanical Parts Made of Steel or Cast Iron, Proc. 18th International Colloquium Tribology—Industrial and Automotive Lubrication, Jan. 10-12, 2012, 6 pages.
Zhmud, Boris, Developing energy-efficient lubricants and coatings for automotive applications, Tribology & Lubrication Technology, Sep. 2011. pages 42-49.

* cited by examiner

TRIBOLOGICAL SYNTHESIS METHOD FOR PRODUCING LOW-FRICTION SURFACE FILM COATING

STATEMENT OF GOVERNMENT INTEREST

The United States Government has certain rights in the invention pursuant to Contract No. W-31-109-ENG-38 between the U.S. Department of Energy and the University of Chicago operating Argonne National Laboratory.

FIELD OF THE INVENTION

The present invention relates generally to a synthesis method for producing low-friction surface film coatings. More particularly the invention is related to an improved method for tribological processing of a substrate with controlled parameters to produce a selected structure having advantageous low-friction film properties. Parameters such as processing temperature, contact load or pressure, relative sliding velocity, chemical environment and substrate material selection can be controlled to form a surface film or structure containing amorphous phase material or amorphous/crystalline material phase having the desired low-friction film properties.

BACKGROUND OF THE INVENTION

Friction control at sliding contact interface has been, and is still, a perpetual pursuit in the field of machine components and mechanical system technology. In some systems, relatively high friction is desirable, e.g., in brake system; however, in the vast majority of mechanical systems, friction reduction is the main goal. Lower friction usually translates to higher efficiency, better reliability and durability, all of which are desirable in machine components and mechanical systems, such as internal combustion engines ("ICE"), gearboxes and transmission systems in transportation vehicles for instance.

Currently, there are numerous approaches and strategies used for friction control, (mainly friction reduction). These include surface modification in terms of coatings or texturing and bulk material development and treatment. However, the most commonly used approach is by lubrication, either with grease or fluid lubricant. Lubricants are complex fluids consisting of basestock fluid and material specific functional additives, such as anti-wear ("AW") and extreme pressure ("EP") additives. These functional additives are designed to react with the surface materials under various contact conditions to form a thin surface layer, commonly referred to as tribochemical or boundary films. Effective lubrication of sliding interface is accomplished preferably through three structural components, namely lubricant fluid film, the tribochemical surface film and the near surface material. The overall friction, wear and other surface damage mechanisms occurring at lubricated sliding interface are all determined by the action of these three structural components.

More specifically, friction at a lubricated sliding interface is determined by the simultaneous shearing of one or more of the three structural elements depending on the operating lubrication regime. In the hydrodynamic and elastohydrodynamic regimes, the lubricant fluid film thickness is large enough to completely separate the two surfaces in sliding contact. Hence, under these regimes, the overall friction at the sliding interface is determined primarily by the shearing of the lubricant fluid film. Consequently, lubricant viscosity and other rheological properties govern the friction behavior. In the mixed regime, there is limited direct contact between the asperities on the contacting surfaces. In this regime, the overall friction is then determined by the shearing of the fluid film as well as the shearing of the few asperities in contact and the tribochemical surface film that may form on the asperities. For the case of the boundary lubrication regime, more interactions occur between the sliding surfaces. The near-surface materials often carry a substantial fraction of the contact load and more surface tribochemical films are formed in response to the severe contact conditions of this regime. Hence, in the boundary lubrication regime, the friction is determined by the shearing of all the three structural components, namely the fluid film, the tribochemical surface film and the near-surface material.

Of the three structural components of lubrication, the tribochemical surface film is the least well understood. The films are formed as a result of reaction between the material of surfaces in contact, additives in the oil, the base oil constituents and chemical species from the operating environments. Indeed, the films are best described as moieties of chemical species from many sources. The operating contact conditions in terms of load, speed and temperature also affect the nature of the tribochemical surface films. Consequently, it is very common to have the same oil additives behave in vastly different ways depending on a variety of factors. In addition, the additives and the resulting tribo films can also vary significantly over time. As a result, there are significant spatial, compositional, thickness and properties variations in tribochemical films.

There is a clear need for better understanding of the contributions and role of the tribochemical surface film to the friction and wear behavior of sliding surfaces. The traditional and usual approach of chemical analysis of the tribochemical films, while useful and perhaps needed, have not yielded fruitful results in terms of understanding the film's role in tribological performance. A new approach focusing on the material characteristics (structure) of the film is more fruitful as described hereinafter.

SUMMARY OF THE INVENTION

A method with selected control of tribological processing temperature and chemical environment for selected substrates has been developed to establish a correlation between the structure of the film and the resulting frictional behavior of the tribological film. In general, films with amorphous or amorphous and crystalline mixture structures yielded low friction behavior, while films with substantially only crystalline structures exhibit higher frictional properties. By using thermal treatment, chemical environment controls and selected substrates, film structures were selectively produced of low-friction surface films synthesized by means of tribochemical surface reactions on a variety of substrate materials. The films exhibited superior low frictional properties compared to the current state-of-art low-friction diamond-like-carbon ("DLC") coatings under dry sliding contact. The tribochemical films were also durable and were able to sustain contact pressure in excess of 3 GPa. The new types of films have enormous potential application in various tribological components and systems.

These and other objects, advantages and features of the invention, together with the organization and manner of operation therefore, will become apparent from the following detailed description when taken in conjunction with the accompanying drawings, wherein like elements have like numerals throughout the several drawings described below.

BRIEF DESCRIPTION OF THE DRAWINGS

FIGS. 1(*a*)(1) and 1(*a*)(2) illustrate contact schematics for tribological analyses and FIG. 1*b* shows a picture of a high frequency reciprocating rig ("HFRR") test rig contact for producing tribochemical surface films;

DETAILED DESCRIPTION OF PREFERRED EMBODIMENTS

Figure 1B:
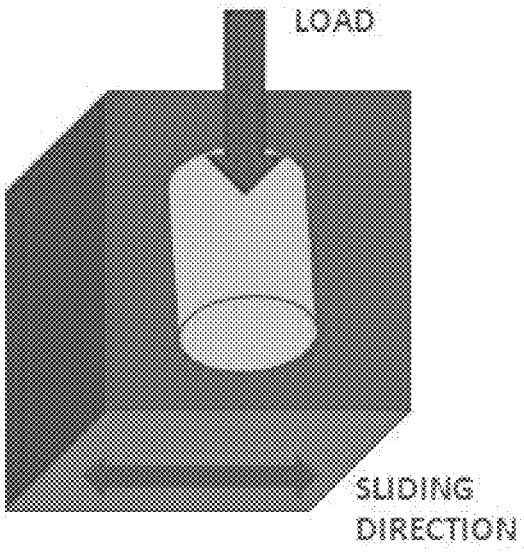
Figure 1B:
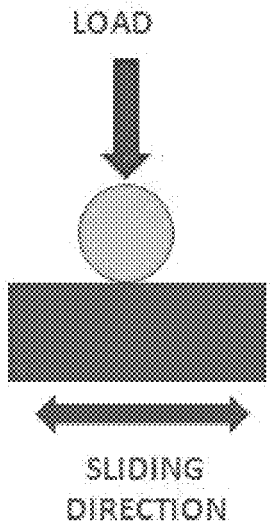
Figure 1B:
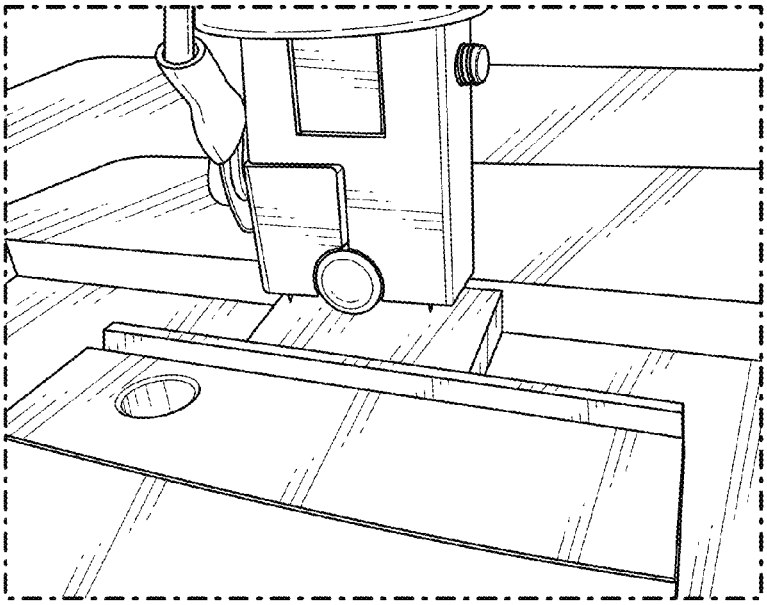
Figure 2A:
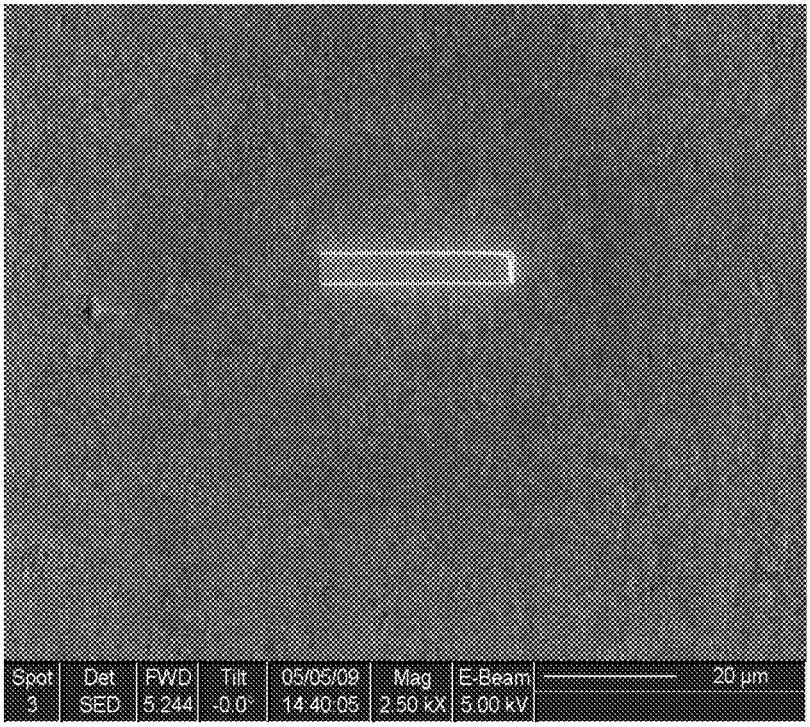
FIGS. 2(*a*)-2(*d*) shows an FIB procedure for cross-sectional TEM sample preparation.
Figure 2B:
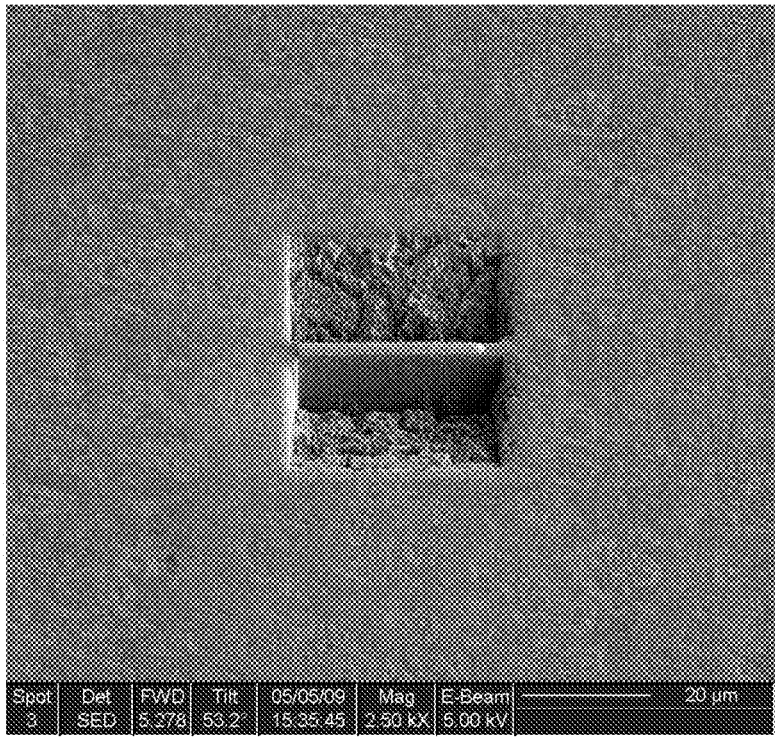
Figure 2C:
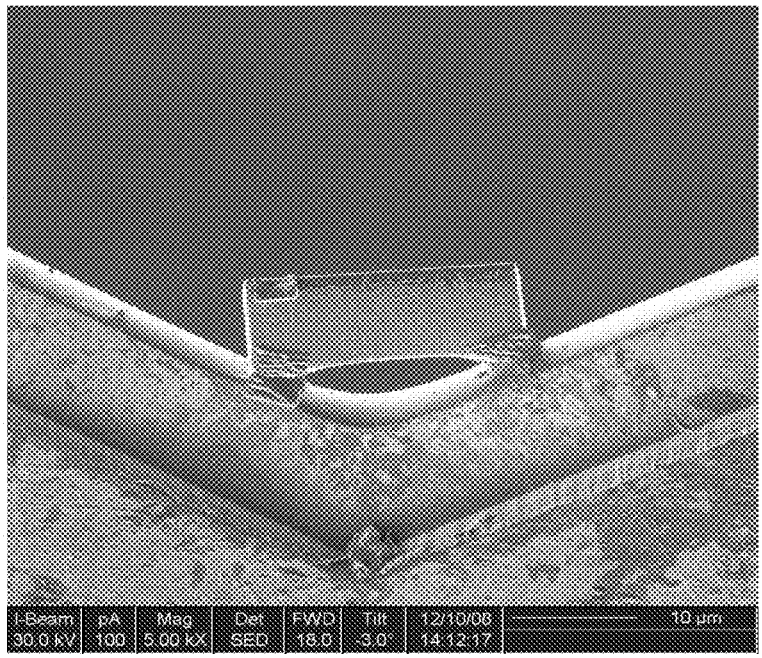
Figure 2D:
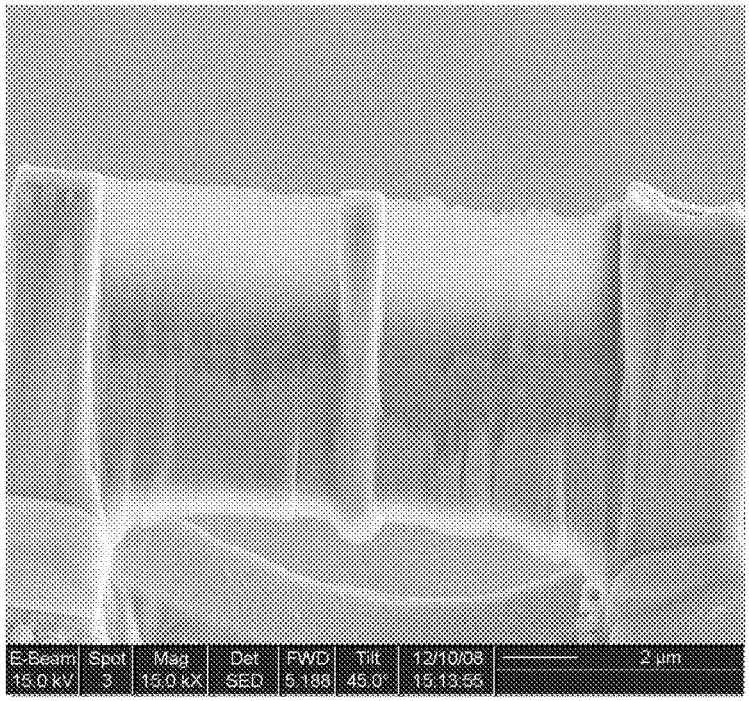

In a preferred form of the invention tests of selected substrate wear were conducted using the system and methods of FIGS. 1(*a*)-1(*c*) and FIGS. 2(*a*)-2(*d*). In one embodiment several oils (A, B and C) were provided with a variety of additives. The Examples hereinafter described provide details of the test system for forming the tribological films and methods for imposing and controlling parameters and for analyzing the product films.

Figure 3:
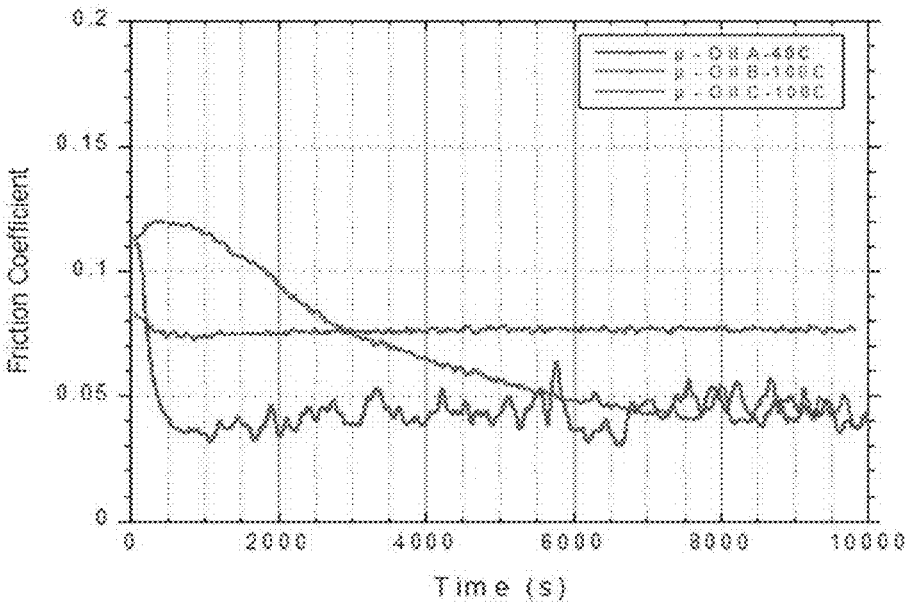
FIG. 3 shows friction coefficient variation with time for three different oils.

The frictional behavior during the reciprocating sliding contact for the lubricants can be divided into three broad groups as typified by oils A, B, and C as shown in FIG. 3. In one embodiment, represented by oil A, sliding started with a relatively high value of 0.11 friction coefficient (which is typical of boundary lubrication regime), followed by a rapid decrease over 10 minutes (600 sec) of sliding to a near constant value of about 0.04 for the remaining duration of the test. In another embodiment, sliding includes again starting with a relatively high friction coefficient of about 0.11, but then followed by a gradual decrease in a near exponential manner over the next 2 hours of sliding to a near steady value of 0.04. This type of behavior for this embodiment is illustrated by oil B in FIG. 3.

In a third example embodiment, frictional behavior includes sliding with the friction coefficient nearly constant and relatively high for the entire duration of the test. Oil C shown in FIG. 3 illustrates this type of frictional behavior.

The viscosity of the three oils in FIG. 3 is the same, and the operating contact conditions are also the same. Therefore, the lubricant fluid film thickness being tested with the three oils A, B and C are expected to be the same, according to the well-known elastohydrodynamic ("EHD") theory. Similarly, the materials used as well as the surface roughness of the samples used for the testing of the three oils are the same. Therefore, the contribution of near surface material to friction is expected to be the same. Consequently, differences observed in the friction behavior can only be attributed to differences in tribochemical surface films structural element of lubrication, since the fluid film and near-surface material elements are the same for all the lubricants. Furthermore, estimation of the ratio of lubricant fluid film thickness (h) to the composite surface roughnesses of the two surfaces in sliding contact ($\sigma$); the so-called lambda ($\lambda$) ratio i.e. $\lambda=h/\sigma$ gave a value of about 0.03 at the start of test and about 0.01 at the end of test for the three lubricants. These values of $\lambda$ ratio showed that the contacts in the tests with the three lubricants were operating under severe boundary lubrication regime at all times during the test. Consequently, frictional transitions in tests with oil A and B were not the result of transition in the lubrication regime, but due to the formation, and some attributes, of the tribochemical surface films.

Figure 4A:
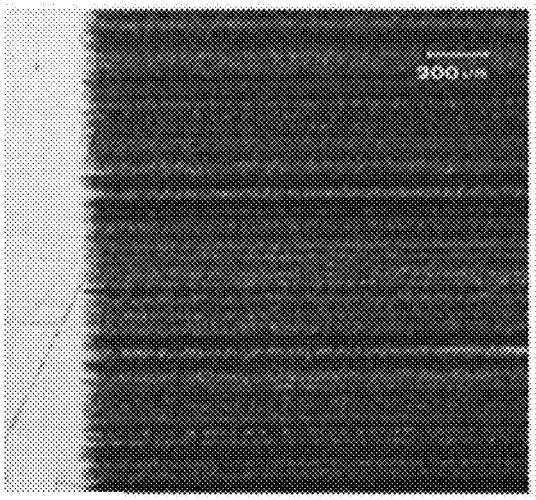
FIGS. 4(*a*)-4(*c*) shows optical micrographs of typical tribochemical surface films processed herein.
Figure 4B:
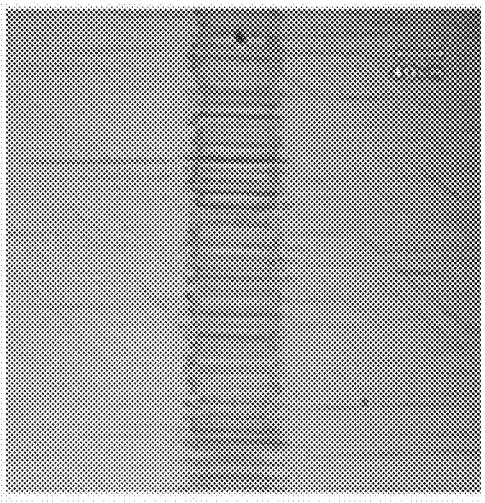
Figure 4C:
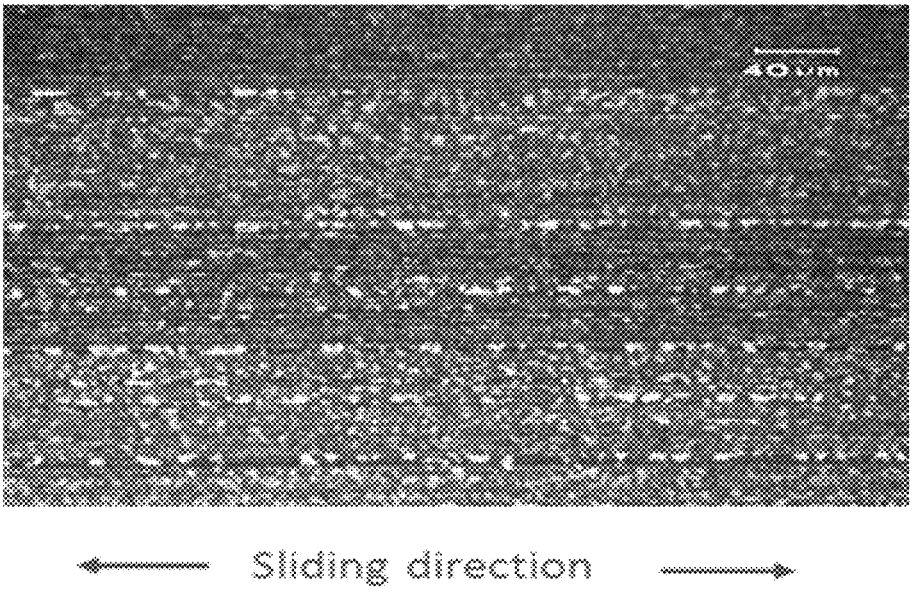
Figure 5A:
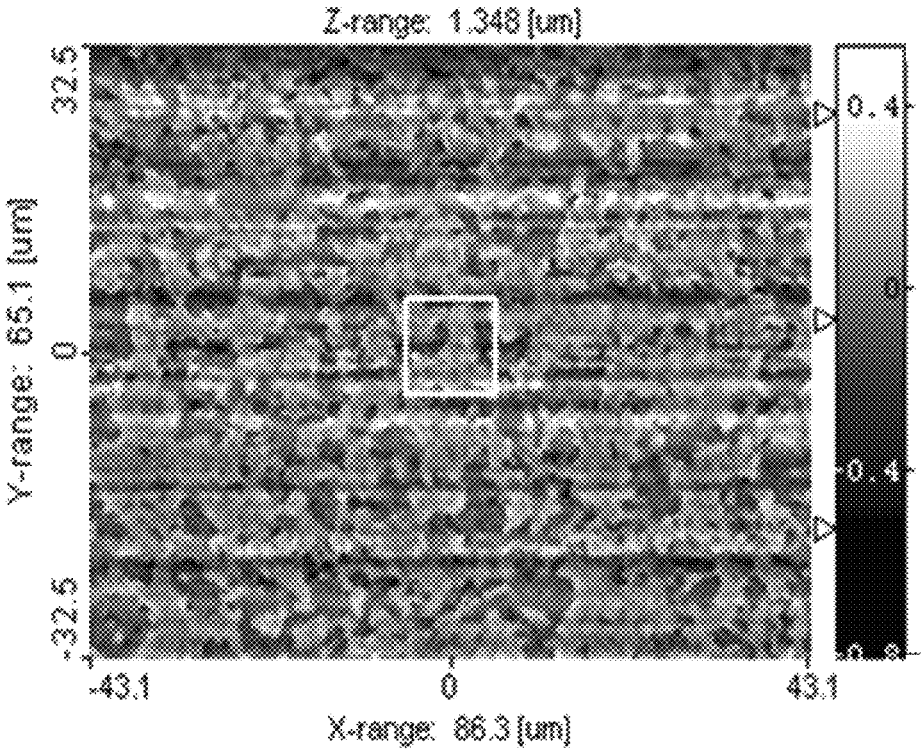
FIG. 5(*a*) shows optical profilometry of the topography of typical tribochemical surface films prepared herein and FIG. 5*b* shows a high magnification of a boxed area of a film.
Figure 5B:
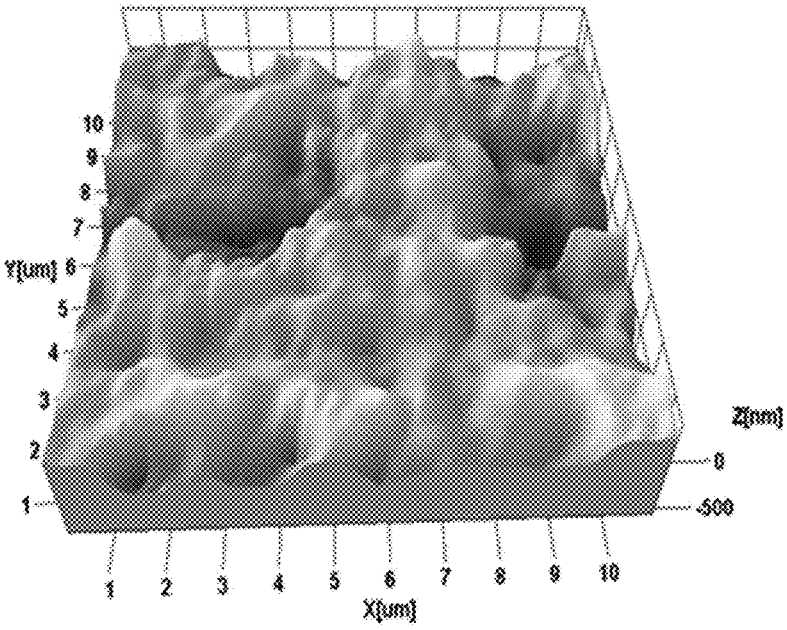
Figure 6A:
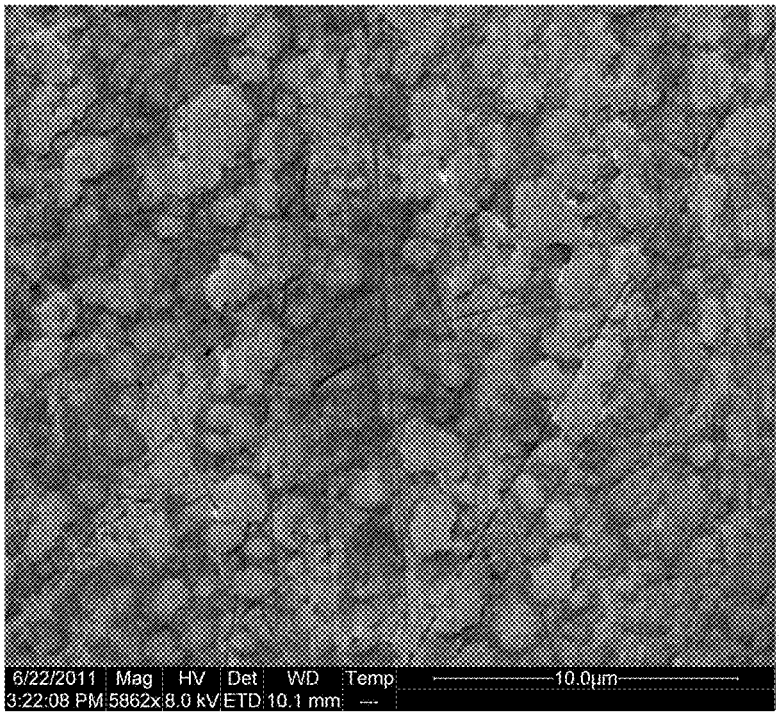
FIGS. 6(*a*)-6(*c*) show SEM micrographs of tribochemical surface films formed from oils A, B and C, respectively.
Figure 6B:
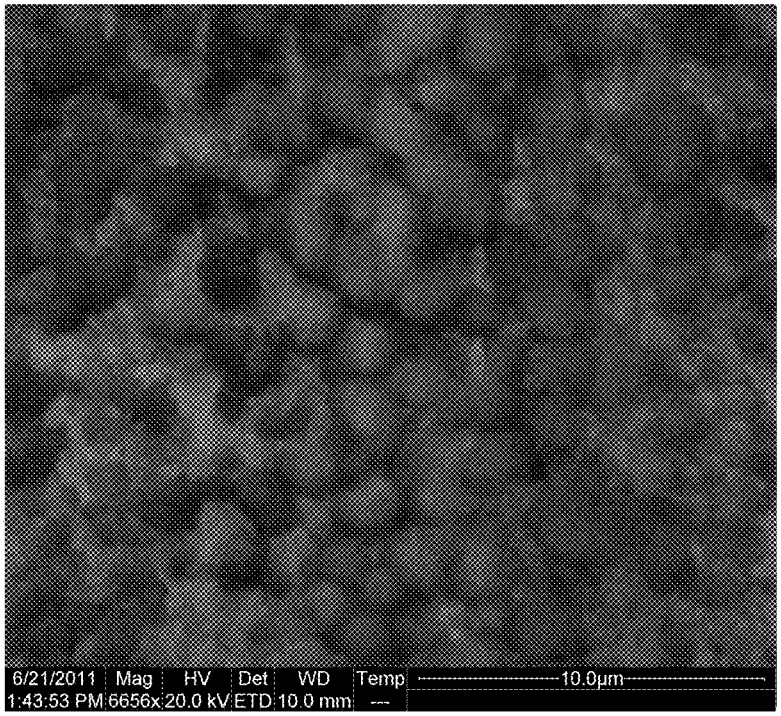
Figure 6C:
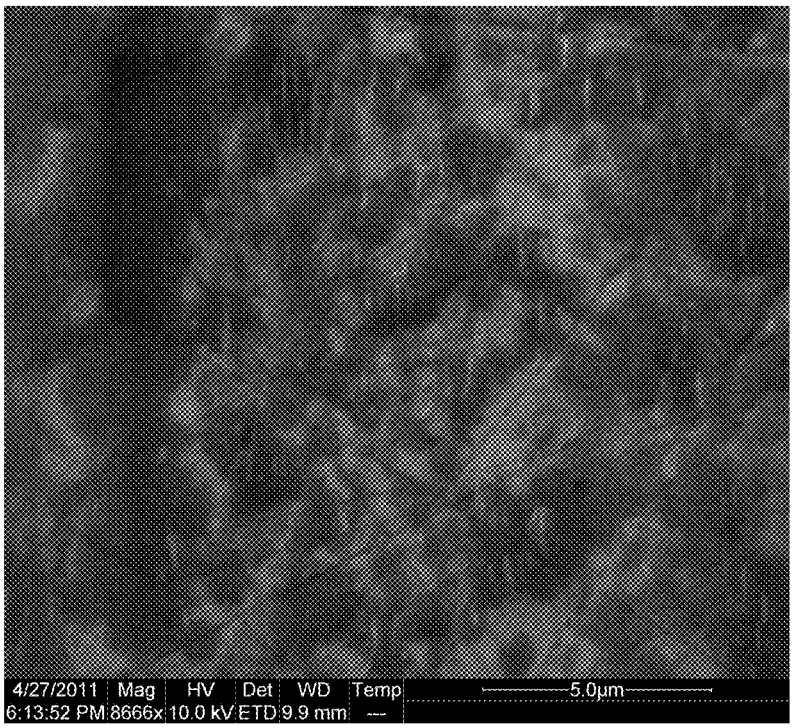

Optical microscopy and profilometry of typical tribochemical surface films are shown in FIGS. 4(*a*)-4(*c*) and FIGS. 5(*a*) and 5(*b*). Both figures show that surfaces tribochemical films are not homogeneous or uniform, but rather "patchy". This topographical heterogeneity is expected as film formation and transformations are initiated and often confined to the real area of contact or asperity contacts. In addition, the tribofilm is also dynamic with time involving formation and removal as the test progresses, ultimately reaching a steady state. Scanning electron microscopy (SEM) micrographs of tribochemical films formed in the test with oils A, B and C are shown in FIGS. 6(*a*), 6(*b*) and 6(*c*), respectively. The heterogeneous nature of the tribofilms is clear from the figures.

Figure 7A:
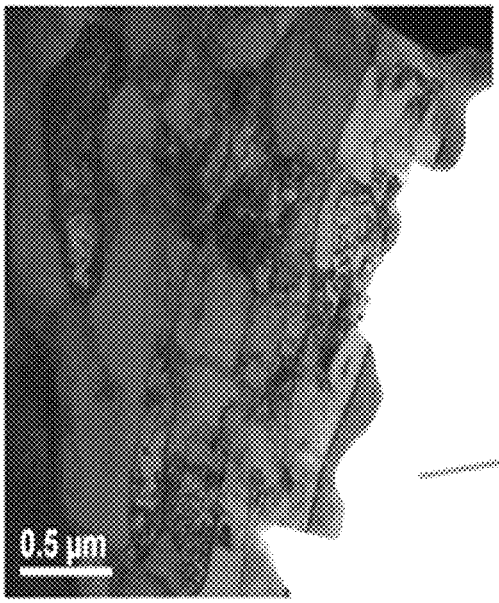
FIGS. 7(*a*) and 7(*b*) show TEM micrographs at different magnifications of a monolayer 100 nm thick surface tribochemical film.
Figure 7B:
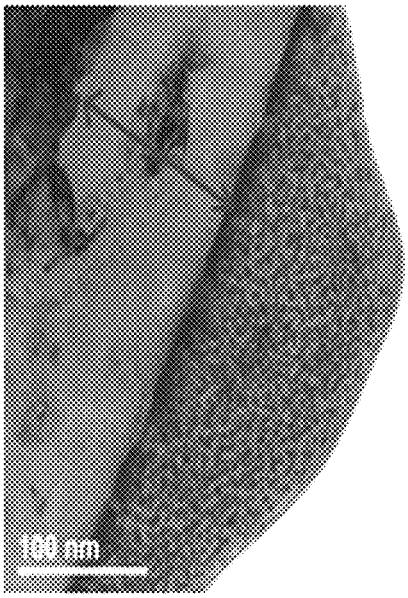
Figure 8A:
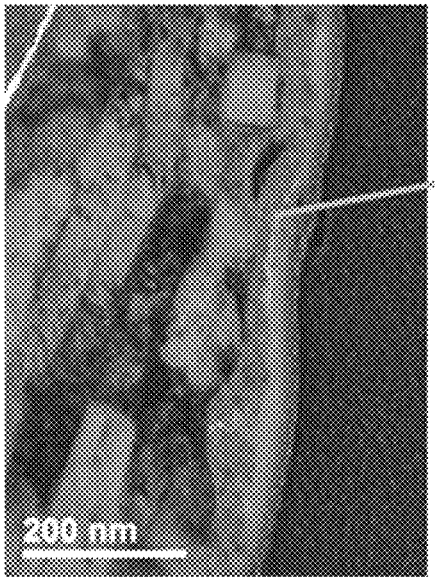
FIGS. 8(*a*) and 8(*b*) show TEM micrographs at different magnifications of a multilayer 120 nm thick surface tribochemical film.
Figure 8B:
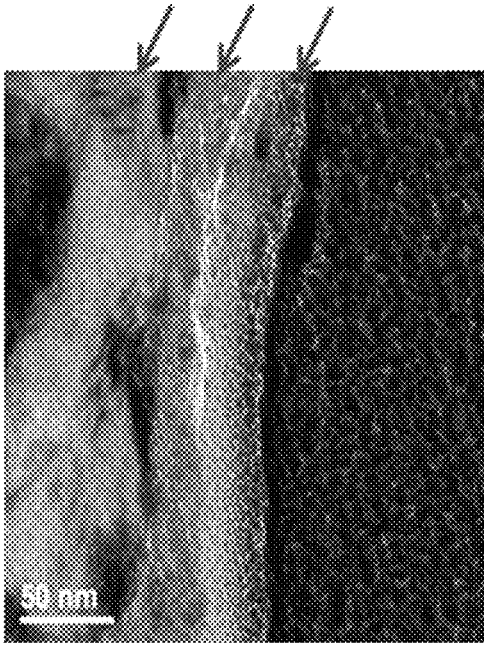

More detailed information and differences between the nanostructure of the tribochemical films were obtained from micrographs of cross-section transmission electron microscopy ("TEM") prepared as shown in FIGS. 2(*a*)-2(*d*). Some tribochemical films were observed to be a monolayer film as illustrated in FIGS. 7(*a*) and 7(*b*). Others are multi-layers, in which different bands are observed (see FIGS. 8(*a*) and 8(*b*)). These films were observed to be in the range of about 50-120 nm average total thickness. In all cases, the thickness of the films is not uniform, which is consistent with other observations of surface morphology and was expected since the nano scale contact that initiates tribofilm formation is not uniform.

Figure 9A:
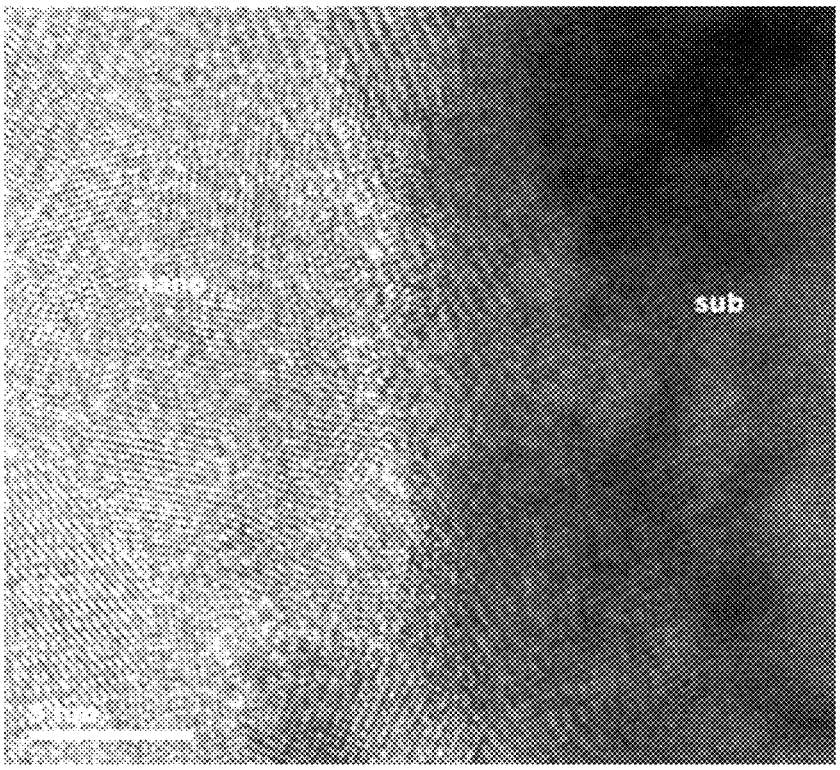
FIGS. 9(*a*) and 9(*b*) show TEM micrographs at different magnifications of tribochemical films with crystalline structure in selected areas of the film.
Figure 9B:
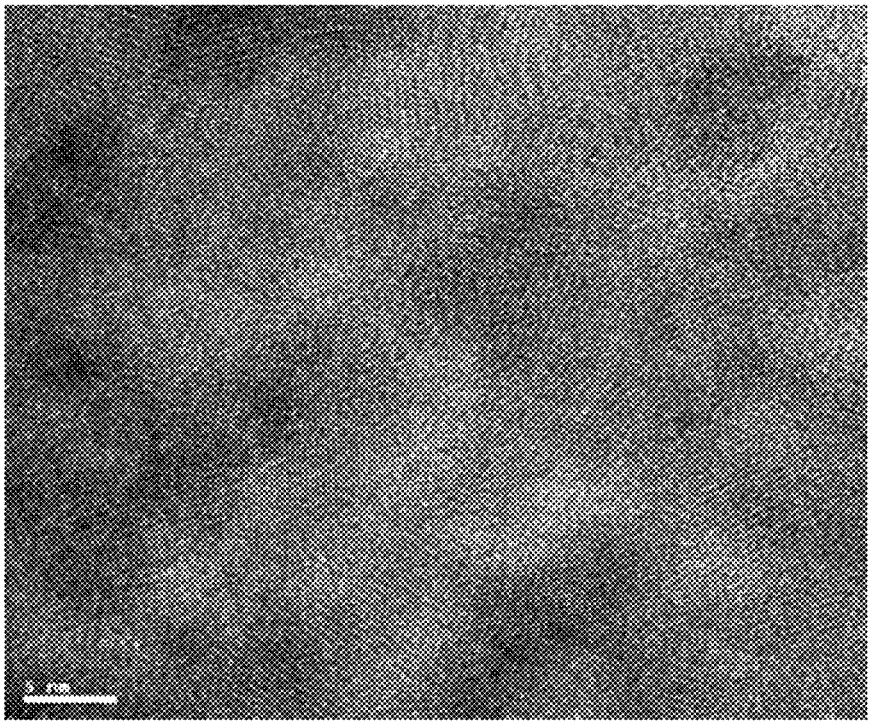
Figure 10A:
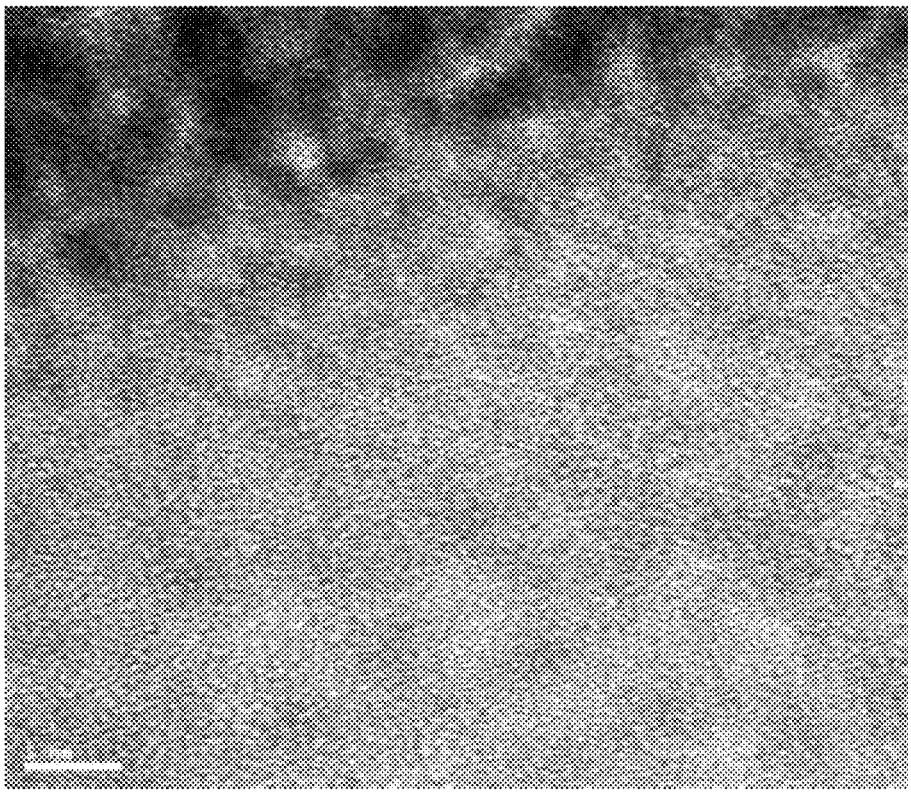
FIGS. 10(*a*) and 10(*b*) show TEM micrographs at different magnifications of tribochemical films with an amorphous structure.
Figure 10B:
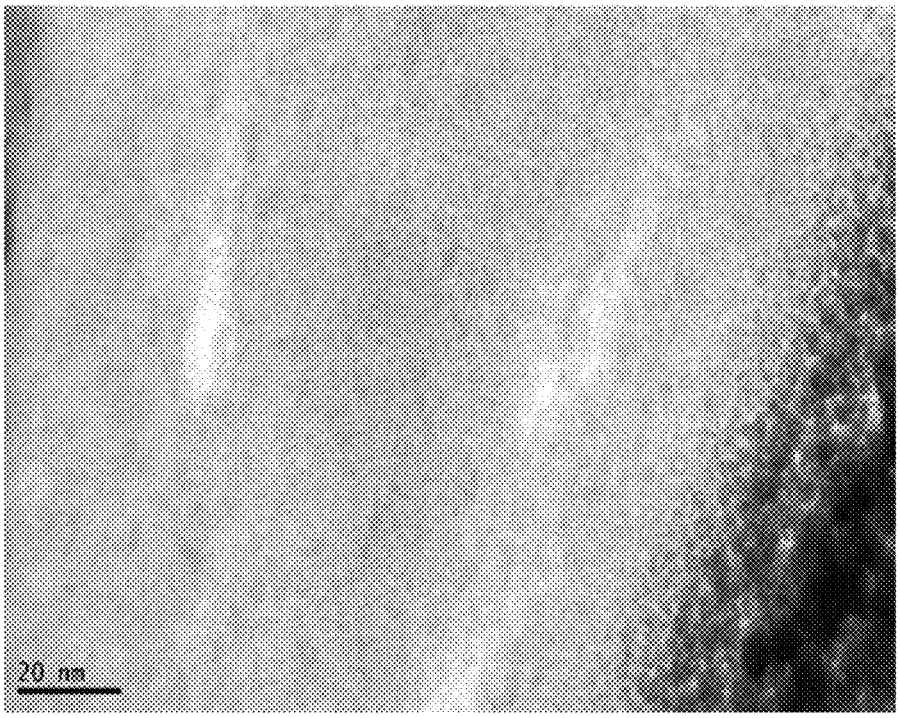
Figure 11A:
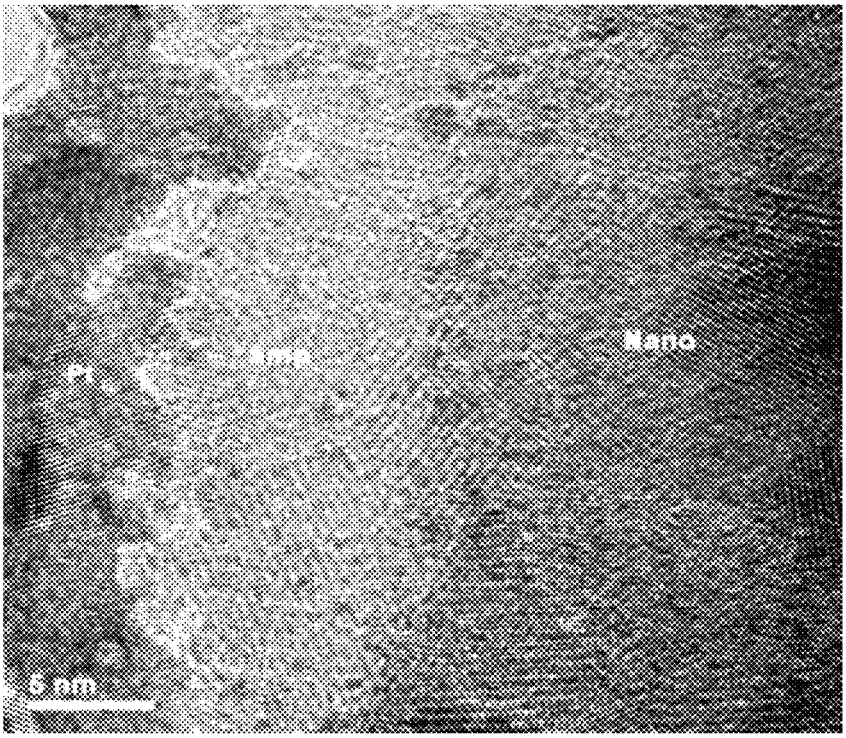
FIGS. 11(*a*) and 11(*b*) show TEM micrographs at different magnifications of tribochemical films with amorphous/crystalline mixture structure.
Figure 11B:
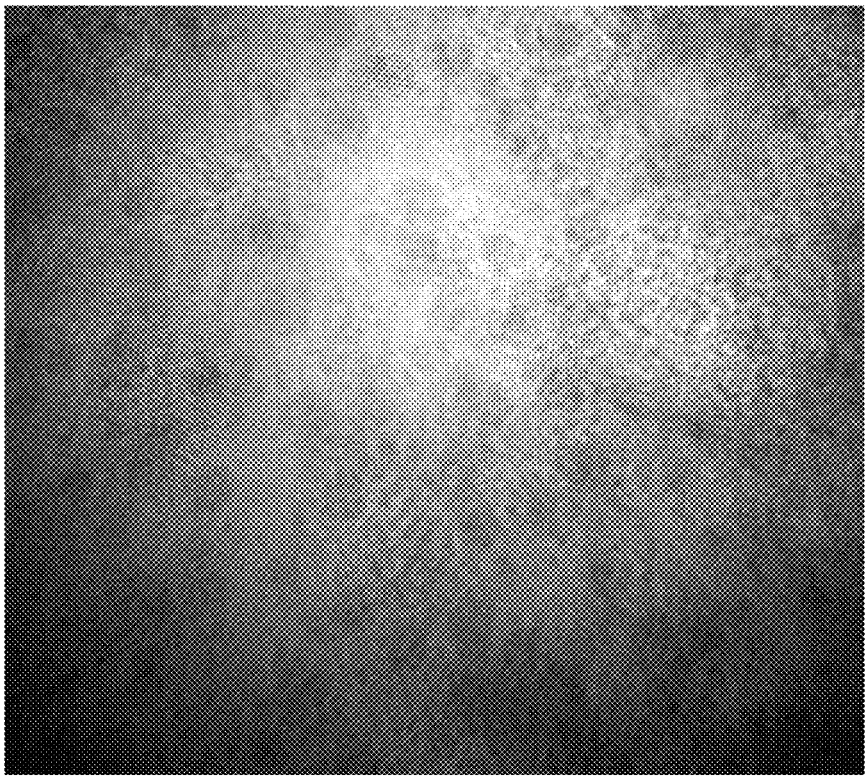

A much more detailed examination of different tribochemical surface film by high resolution TEM showed that some films consist of nano-crystalline materials as illustrated in FIGS. 9(*a*) and 9(*b*). The prominence of lattice fringes is an indication of the film crystallinity. Excellent bonding between the film and steel substrate material is also apparent in FIG. 9(*a*) which is the micrograph of the film-substrate interface. Some other films are observed to be amorphous, in which there is no indication of long range order, as indicated by lack of lattice fringes in the TEM image (see FIGS. 10(*a*) and 10(*b*)). There are also films consisting of a mixture of amorphous and nano-crystalline particles. An example of film with mixture of phases is shown in FIGS. 11(*a*) and 11(*b*). Lattice fringes for islands of the ordered domains of nano-crystals can be seen in the matrix of disordered amorphous phase.

Based on the frictional behavior of lubricated surfaces under boundary regime with a variety of additives (some model lubricant and some commercial lubricant), and also on structural analysis of the tribochemical films, a firm connection was established between the structure and frictional properties of the films. In all the cases evaluated, tribochemical films with crystalline structure always exhibit high and nearly constant friction coefficient of between 0.075 and 0.15 as exemplified by oil C in FIG. 3. On the other hand, tribofilms with amorphous structures or amorphous-crystalline mixture structures, always showed relatively low steady state friction; as low as 0.03 in boundary regime. Examples of such behavior are oils A and B in FIG. 3. This correlation between the friction and the tribochemical film structure was observed in all cases studies; in both model and commercially formulated lubricant. Again, calculation of the $\lambda$ ratio at the beginning and end of test showed that all the contacts in which the different frictional characteristics were observed were all under severe boundary lubrication regime ($\lambda<0.1$). Thus, the low-friction when observed cannot be due to transition in the lubrication regime from boundary to mixed or EHD regime. Rather it is due to the frictional property of the tribochemical film which is determined by the film structure. This is a significant and a major observation in the quest for sustainable friction reduction under the boundary lubrication regime. The key to boundary lubrication regime friction reduction is the control or modification of the structure of tribochemical surface film formed during sliding contact.

With the establishment of a firm correlation between the structure and the frictional properties of the tribochemical films, the pathway to low-friction surface film is through structure control and modification. There are many factors and parameters that determine and control the structure of solid materials. These include chemical composition, pressure, and temperature. A preferred embodiment common approach to structural transformation in solid material is via thermal treatment. Consequently, in a most preferred embodiment a thermally-based approach was adopted for tribochemical film structure modification in this investigation. Two types of tests were conducted with several lubricants in which the temperature were varied; (1) isothermal tests at different constant temperatures ranging from about 10° C. to 150° C., and (2) continuously varying temperature, ranging from 23° C. (RT) to about 150° C. Estimation of the $\lambda$ ratio indicated that all the tests were under severe boundary lubrication regime; $\lambda$ ratio was less than 0.2 for tests in all the temperature range used for testing.

Figure 12A:
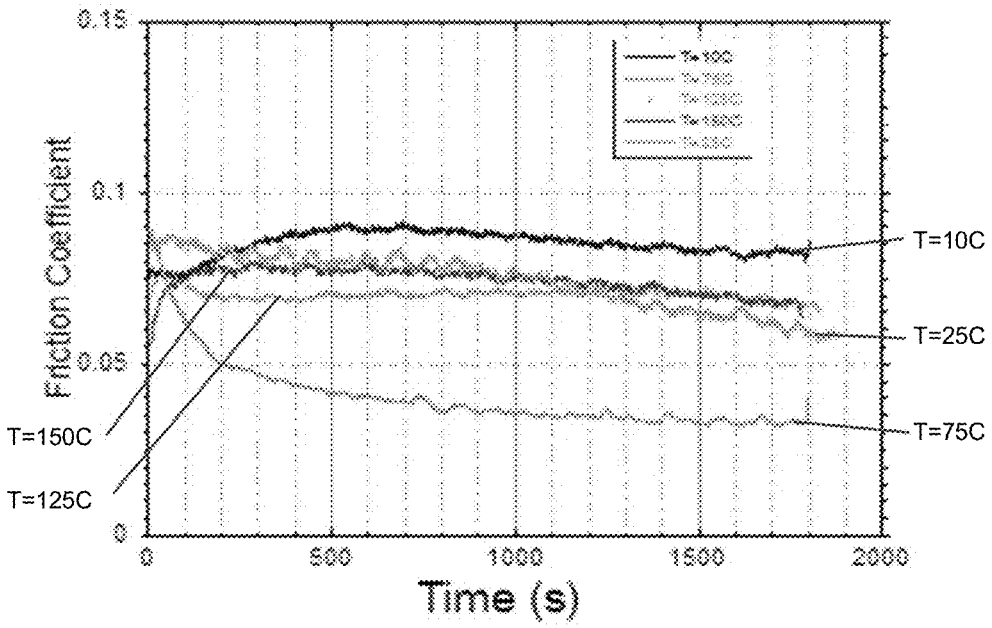
FIGS. 12(*a*) and 12(*b*) show effect of temperature on friction behavior of model lubricant with 12(*a*) for isothermal conditions and 12(*b*) for continuously varying temperature.
Figure 12B:
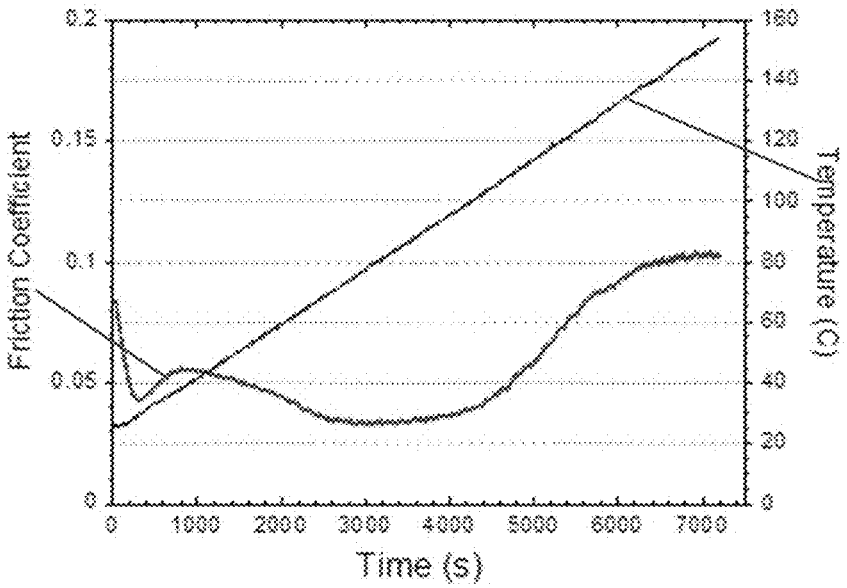

FIG. 12(*a*) shows an example of frictional behavior under isothermal test conditions for a model lubricant consisting of a poly alpha olefin ("PAO") basestock with anti-wear ("AW") and friction modifier ("FM") additives. While the frictional behavior at most test temperatures are similar to one and another, a peculiar behavior of a decrease in friction coefficient to a very low and sustained value was observed in the test conducted at 75° C. This result suggests that for this particular lubricant, there is a "high-friction" and "low-friction" temperature regime. The effect of temperature on the frictional behavior with this lubricant is much clearer in the results of continuously varying temperature test shown in FIG. 12(*b*). A complex variation of friction with temperature was observed as the contribution of the three structural elements of lubrication changes with temperature. As the temperature increases, the viscosity of the oil lubricant decreases, resulting in reduction of oil film thickness and oil film shear strength, and the result is a reduction in friction. However, as the oil film thickness decreases, there is more direct interaction between asperities of near surface material, leading to an increase in sliding interface shear resistance and friction. Concurrently, as the temperature increases, the rate of surface reaction to form tribochemical surface film also increases. As the surface reaction film is formed, its contribution to friction increases. Based on the results of numerous analyses presented in this paper, if the tribochemical film has an amorphous structure, its friction will be low; and if it has a crystalline structure, its friction will be high.

For the model lubricant of FIGS. 12(*a*) and 12(*b*), results of both isothermal and the continuously varying temperature tests are consistent with each other. A low-friction regime was observed between about 60-100° C. and a relatively high-friction regime was observed at higher temperatures. Analysis of the structure of the low-friction regime film showed that it is amorphous, while the high friction film was crystalline.

Figure 13:
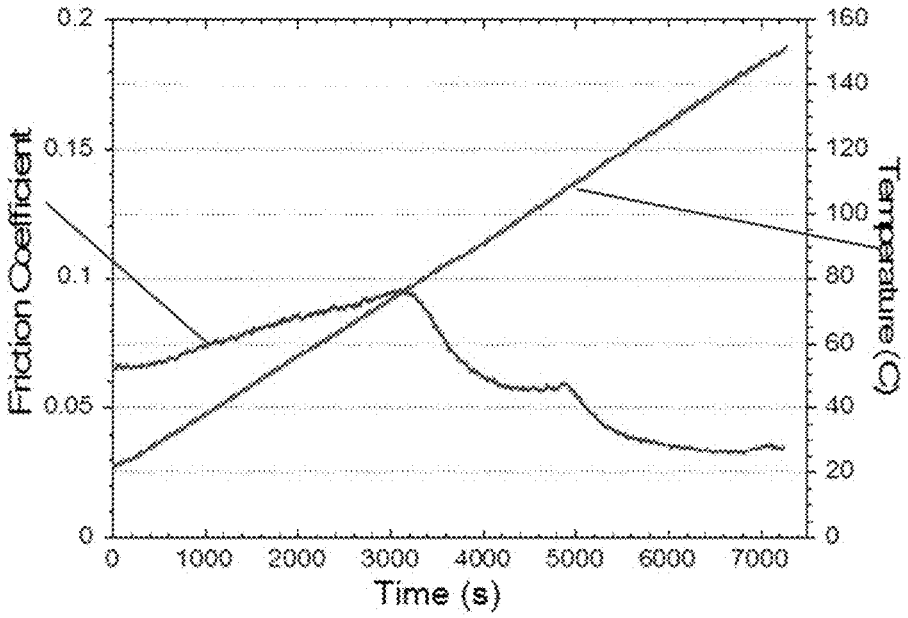
FIG. 13 shows effect of temperature on friction behavior of fully formulated lubricant under continuously varying temperature.

A continuously varying temperature test was also conducted with fully formulated commercial lubricants optimized for both friction and wear. FIG. 13 shows the variation of the friction coefficient with temperature. Again at the initial state of the test (<70° C. temperature, approximately), the increase in friction can be attributed to a decrease in oil viscosity and the reduction of the oil film thickness. However, as tribochemical film formation occurs, a gradual decrease in friction was observed with increasing temperature. Another transition to an even lower friction was observed at a temperature of about 110° C., with the final friction coefficient as low as 0.03. For a boundary lubrication regime, this is a remarkably low friction coefficient. This result is attributed to the formation of a very low friction surface coating by tribochemical surface reaction during sliding contact. Analysis of the tribochemical film formed showed it was a multi-layer amorphous structure.

Low-friction thin-film coatings are increasingly being used for a variety of tribological applications under both lubricated and unlubricated contact conditions. A variety of thin-film low-friction coatings, with various chemical compositions are commercially available and being developed. Examples of currently available low-friction coatings include different types of well known diamond-like carbon ("DLC") and other forms of coatings. These coatings are produced by numerous types of vacuum-based deposition processes, such as different variants of PVD and CVD techniques. The thickness of these PVD and CVD low-friction coatings typically ranges from 1-10 μm.

Based on the observation of the relationship between the structure and frictional behavior of tribochemical surface film, coupled with the ability to control film structure by a thermal process, low-friction ultra-thin coatings or surface films were produced via tribochemical surface reaction. The process involves the selection of a working fluid lubricant, preferably a hydrocarbon, into which additives that can produce a film with the desired structure is added. Low-friction films or coating can be produced from fully formulated lubricants containing friction modifier ("FM") additives. The model additives used to produce tribochemical surface films consist of organo-metallic compounds that contain elements that can bias the system to form an amorphous solid phase. Elements in the additives include Zn, Mo, Ca, S, P, O, N, C and compounds containing these elements that result in release from their compounded state in the lubricant. Additives with other chemical species that can bias formation of an amorphous solid phase, such as B, Si, Al, and Ti (and their compounded states) can also be used to produce low-friction films. These elements can be gaseous, liquid or solid form so long as they can be released from their compounded state to form a new compound during the tribological processing. If high-friction film is desirable, then additives that will form only crystalline films should be selected. The key to friction control in this approach is not so much about additive chemistry, but more on the structure of the tribochemical surface film that is formed.

Figure 14:
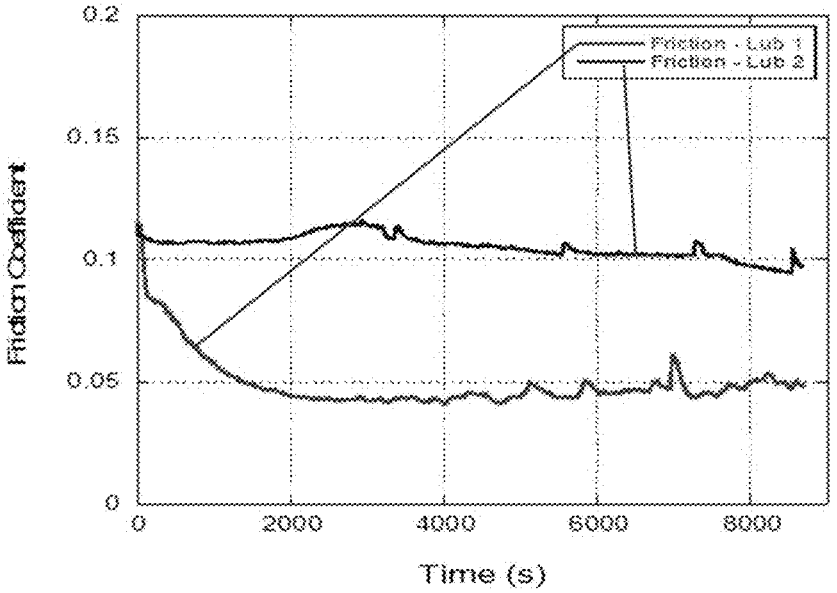
FIG. 14 shows friction variation with time during tribochemical surface film synthesis.

Once a proper working fluid is selected, sliding contact conditions should be selected to ensure a boundary lubrication regime. Taking the viscosity of the working fluid into account, contact load and sliding speed should be selected such that the $\lambda$ ratio is less than 0.2. As shown hereinbefore, temperature is another parameter useful for film structure control. By monitoring the friction coefficient continuously during the film production, the structure of the resulting film can be inferred. FIG. 14 shows the variation of friction with time during the synthesis of two films, one with amorphous structure and low-friction and the other with crystalline structure and relatively high-friction. FIG. 14 is an illustration of film structure inference from the friction behavior during film formation.

Two different types of low-friction tribochemical surface films were produced from a model working fluid consisting of poly-alpha-olefin ("PAO") synthetic hydrocarbon with a Mo-organo-metallic compound plus a Zn-organo-metallic compound and the second from a fully formulated synthetic gear oil containing an FM additive.

Figure 16:
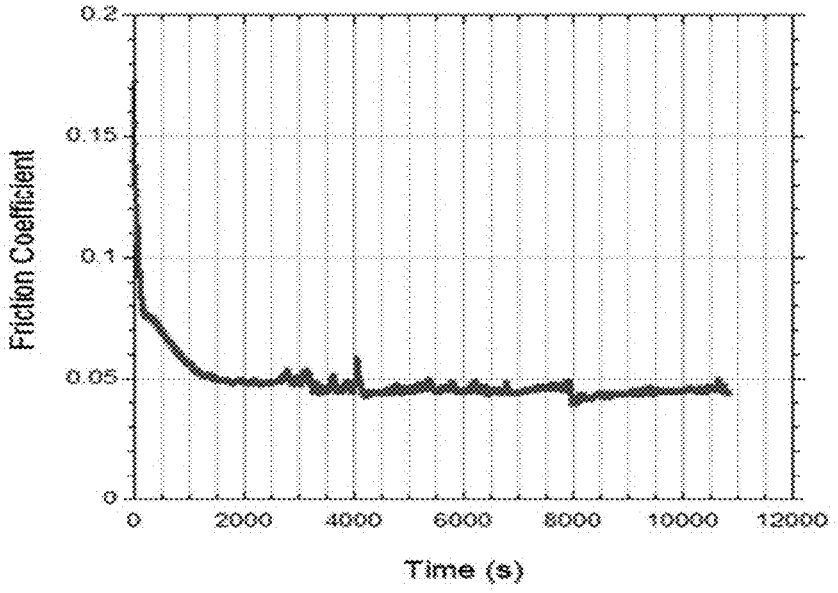
FIG. 16 shows friction variation during the synthesis of low-friction tribochemical films on a CrN substrate.

Films were produced on hardened and polished AISI 4120 steel using a 52100 steel roller counterface in reciprocating sliding contact. A normal load of 150N was applied at a reciprocating frequency of 0.5 Hz over a stroke length of 2.1 cm. A temperature of about 100° c. was used and the duration was 3 hours under a fully-flooded contact conditions. Friction variation during the film synthesis showed the two films are of the low-friction variety as indicated in FIG. 14. Films with low friction behavior similarly were also produced on a Chromium Nitride (CrN) ceramic material substrate from the same model working fluid as shown in FIG. 16.

After film formation, the samples with the tribochemical films were cleaned with solvents to remove excess hydrocarbon fluid and warm air dried. Cross-sectional analysis showed that both films had a thickness of about 100 nm, making them ultra-thin in comparison with the typical 1-10 μm of DLC low-friction coatings usually produced by PACVD or other techniques. One film (BF-2) was observed to be of an amorphous-crystalline phase mixture in a ratio of about 60/40 respectively, while the other film (BF-1) is all amorphous.

The friction and durability of the films were evaluated using a reciprocating sliding contact test between the film and a 6 mm diameter and 10 mm long steel roller under dry ambient room conditions and temperature. Tests were conducted at a reciprocating frequency of 1 Hz and a stroke length of 20 cm. Step-load increase protocol was used, in which tests started at a load of 50N, followed by step-load increases of 25N every minute until failure occurred as indicated by a sudden rise in the friction coefficient. Comparative tests under the same contact conditions were also conducted with two different state-of-the-art low-friction DLC coatings as well as an uncoated steel surface.

Figure 15:
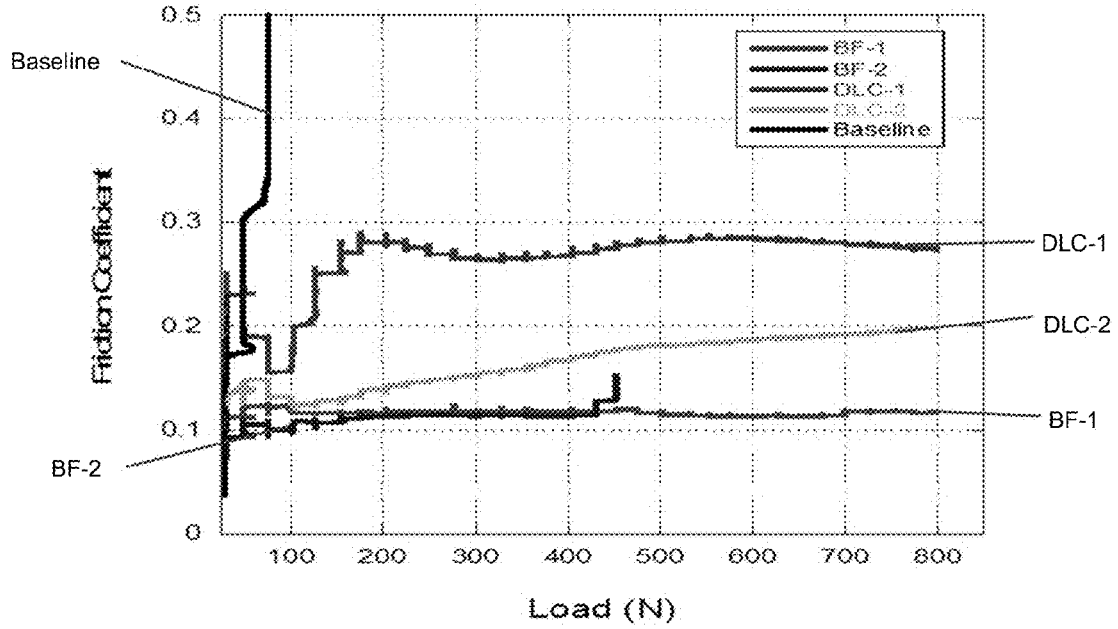
FIG. 15 shows friction behavior of low-friction tribochemical films in comparison with DLC coatings as a function of Load.

Results of the dry tests with tribochemical films (BF1 and BF2) and DLC coatings (DLC-1 and DLC-2) are shown in FIG. 15, which shows a plot of the variation of the friction coefficient with increasing contact load. For the uncoated steel surface, the friction showed a sudden rise during the second load stage of 75N and consequent failure by scuffing. Both tribochemical films showed the lowest friction coefficient of about 0.1 for all contact loads. This level of low friction is typical for oil-lubricated steel surfaces, making the frictional behavior of tribochemical films remarkably low. The fact that their friction is independent of load is also remarkable. Compared to the DLC coatings, friction of tribofilms is consistently lower. Friction of DLC-2 is comparable to the tribofilm at relatively low loads (up to 200N). At higher loads, however, the DLC-2 friction gradually increased for the duration of the test, ending with a final value of 0.2 friction coefficient at 800N, which is the maximum load for the test equipment. DLC-1 showed a considerably higher friction with a steady friction coefficient of about 0.29 at higher loads (>200N).

In terms of durability, one of the tribochemical films (BF-1) did not fail until the maximum normal load of 800N, which imposes a normal contact pressure in excess of 3 GPa. The other tribofilm failed at a normal load of 450N, which is still considerably higher than failure loads of many commercially available low-friction coatings. Thus, low-friction and durable, ultra-thin surface films and coatings can be produced via tribochemical surface reaction techniques. The method is carried out through controlling the structure of the film, regardless of its chemical composition.

For tribochemical films with amorphous and nano-crystalline phases mixture, such as BF-2, there is most likely a maximum allowable fraction of crystalline phase in order to maintain the low-friction properties. In bulk metallic glass (BMG) materials with amorphous microstructure, nanocrystalline phase can be precipitated by appropriate thermal annealing treatments. In such bulk materials, which consist of amorphous and crystalline phase mixture, it is well known that a transition occurs in the mechanical behavior of the material when the crystalline phase content is between about 60-70% as a result of the so-call percolation theory. While not limiting the scope of the invention, the theory posits a topological transition from amorphous phase controlled mechanical behavior to a crystalline phase controlled behavior when the crystalline phase content is between about 60-70%. Although, the tribochemical films of the present invention are ultra-thin (100 nm), a critical phase content level for transition in friction behavior is expected between about 60-70% crystalline phase content since friction is connected to mechanical behavior. Furthermore, it is observed that for crystalline tribochemical films, the friction is always high.

The following non-limiting examples illustrate various aspects of producing, analyzing and testing the tribological product films.

Example I

Tribofilm Formation

Tribochemical surface films formation and concurrent friction measurement were conducted using a reciprocating roller-on-flat contact configuration, shown schematically in FIG. 1(*a*) in a high frequency reciprocating rig ("HFRR") in FIG. 1(*b*). The roller specimens are made of hardened AISI 52100 bearing steel with 6.3 mm diameter and 10.3 mm length. The surface was polished to a finish of 50 nm $R_a$ and the hardness is about 7.5 GPa (62 $R_c$). The flat specimens consist of rectangular (24×18×6 mm) case carburized and hardened alloy steel. The flat specimen surfaces were also polished to 50 nm $R_a$ and hardness was also about 7.5 GPa (62 $R_c$).

All the tests were conducted at a normal load of 150N which imposes a nominal Hertzian contact pressure of about 0.40 GPa; reciprocating rate of 0.5 Hz, stroke length of 21 mm giving an average linear velocity of about 1.5 mm/sec. Tests were conducted for duration of 3 hrs under a lubricant fully flooded condition and at various temperatures ranging from 10° C. to 150° C. under both isothermal and continuously varying temperatures. The friction coefficient was continuously monitored in all the tests. Tests were conducted with several lubricants including model ones consisting of common friction modifier (FM) and anti-wear (AW) additives, and fully formulated commercial lubricants optimized for both friction and wear performance attributes. All the lubricants tested all have the same viscosity. This ensures that the lubricant fluid film thickness will be the same for different lubricants under the same contact conditions.

Example II

Surface Tribo-Film Analysis

The morphology and structure of the tribochemical surface films formed from the various lubricants evaluated are determined by several techniques. Optical microscope and profilometry was used to determine the surface roughness of the tribo films. Scanning electron microscopy (SEM) equipped with energy dispersive spectroscopy (EDS) was used to assess the morphology and elemental constituents of the tribo films from different lubricants.

The nano structures of the tribochemical films formed at the lubricated interface were determined by the analytical technique of focused-ion-beam ("FIB") milling and cross-sectional transmission electron microscopy ("TEM"). Use of the FIB techniques for cross-section TEM sample preparation of tribochemical surface involves many steps. Briefly, a strip of protective layer of gold (Au) and platinum (Pt) is deposited on top of tribofilm prior to ion-beam milling in order to protect the film (see FIG. 2(*a*)). Ion-beam milling is done on both sides of the strip (see FIG. 2(*b*)). The thin-slice specimen with the protected surface tribo-films is then extracted and mounted into an appropriate location on the TEM grid (see FIG. 2(*c*)). Finally, thinning to electron transparency, especially in the area containing the tribo film is conducted with ion beam (see FIG. 2(*d*)). The sample can then be examined and analyzed with high resolution TEM. For this study, an FEI Dual Beam 235 FIB system was used for sample preparation and the milling ion was gallium (Ga).

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments, and with various modifications, as are suited to the particular use contemplated.

What is claimed is:

1. A method of forming a low friction tribological surface film comprising:

providing a substrate having a crystalline structure and an opposing wear member;

providing a lubricant; and controlling operating conditions during tribological rubbing processing, to form a film on the substrate wherein the film comprises an amorphous structure formed by the tribological rubbing processing.

2. The method as defined in claim 1 wherein the substrate is selected from the group of steel and a ceramic.

3. The method as defined in claim 1 wherein the amorphous structure comprises at least about 40% of the film structure.

4. The method as defined in claim 1 wherein the lubricant comprises a fluid and an additive.

5. The method as defined in claim 4 wherein the additive is selected from the group of an additive material comprising Zn, Mo, Ca, S, P, O, N, C, B, Si, Al and Ti.

6. The method as defined in claim 5 wherein the additive material is selected from the group of a compound which releases in the lubricant an elemental form of the additive material able to interact with the substrate to form the amorphous structure.

7. The method as defined in claim 4 wherein the additive is selected from the group of a gas, a solid and a liquid.

8. The method as defined in claim 4 wherein the fluid comprises a synthetic hydrocarbon.

9. The method as defined in claim 8 wherein the fluid comprises a poly-alpha-olefin including a Mo-organic-metallic compound and a Zn-organo-metallic compound.

10. The method as defined in claim 8 wherein the fluid comprises a synthetic gear oil containing an FM additive.

11. The method as defined in claim 1 wherein the temperature of the substrate is maintained between about 40-110° C.

12. The method as defined in claim 1 wherein the substrate comprises a steel and the load level is between about 200-800N.

13. The method as defined in claim 1 wherein the substrate comprises a steel and the time of tribological processing is at least about 2000 seconds.

14. The method of claim 1, wherein the lubricant is provided such that the λ ratio is less than 0.2.

15. The method of claim 1, wherein the film has an average thickness of 50 nm to 120 nm.

16. A method of forming a low friction tribological surface film comprising:

providing a substrate having a crystalline structure and an opposing wear member;

providing a lubricant; and controlling operating conditions during tribological rubbing processing, such that λ ratio is less than 0.2, to form a film on the substrate wherein the film comprises an amorphous structure formed by the tribological rubbing processing, the film having at least 30% amorphous phase.

* * * * *